US010940690B2

(12) United States Patent
Giovanola et al.

(10) Patent No.: US 10,940,690 B2
(45) Date of Patent: Mar. 9, 2021

(54) METHOD OF MANUFACTURING AN INK-JET PRINTHEAD

(71) Applicant: SICPA HOLDING SA, Prilly (CH)

(72) Inventors: Lucia Giovanola, Ivrea (IT); Silvia Baldi, Turin (IT); Anna Merialdo, Ivrea (IT); Paolo Schina, Turin (IT)

(73) Assignee: SICPA HOLDING SA, Prilly (CH)

( * ) Notice: Subject to any disclaimer, the term of this patent is extended or adjusted under 35 U.S.C. 154(b) by 0 days.

(21) Appl. No.: 15/557,354

(22) PCT Filed: Mar. 10, 2016

(86) PCT No.: PCT/EP2016/055126
§ 371 (c)(1),
(2) Date: Sep. 11, 2017

(87) PCT Pub. No.: WO2016/150715
PCT Pub. Date: Sep. 29, 2016

(65) Prior Publication Data

US 2018/0236767 A1 Aug. 23, 2018

(30) Foreign Application Priority Data

Mar. 24, 2015 (EP) ..... 15160524

(51) Int. Cl.
*B41J 2/16* (2006.01)
*B41J 2/14* (2006.01)

(52) U.S. Cl.
CPC ..... *B41J 2/162* (2013.01); *B41J 2/1433* (2013.01); *B41J 2/1607* (2013.01); *B41J 2/1623* (2013.01);
(Continued)

(58) Field of Classification Search
CPC ..... B41J 2/162; B41J 2/1629; B41J 2/1628; B41J 2/1607
See application file for complete search history.

(56) References Cited

U.S. PATENT DOCUMENTS 6,214,192 B1 * 4/2001 Hawkins ..... B41J 2/1433 205/118
6,362,512 B1 * 3/2002 Kubby ..... B81B 3/0083 257/415
(Continued)

FOREIGN PATENT DOCUMENTS

EP 1813428 8/2007
EP 2230081 9/2010
(Continued)

OTHER PUBLICATIONS

International Search Report and Written Opinion issued with respect to application No. PCT/EP2016/055126.
(Continued)

*Primary Examiner* — Kyoung Lee
*Assistant Examiner* — Christina A Sylvia
(74) *Attorney, Agent, or Firm* — Muncy, Geissler, Olds & Lowe, P.C.

(57) ABSTRACT

The present application relates to a method of manufacturing an ink-jet printhead comprising: providing a silicon substrate (10) including active ejecting elements (11); providing a hydraulic structure layer (20) for defining hydraulic circuits configured to enable a guided flow of ink; providing a silicon orifice plate (30) having a plurality of nozzles (31) for ejection of the ink; assembling the silicon substrate (10) with the hydraulic structure layer (20) and the silicon orifice plate (30); wherein providing the silicon orifice plate (30) comprises: providing a silicon wafer (40) having a planar extension delimited by a first surface (41) and a second surface (42) on opposite sides of the silicon wafer (40); performing a thinning step at the second surface (42) so as to remove from the second surface (42) a central portion (43) having a preset height (H), the silicon wafer (40) being formed, following the thinning step, by a base portion (44) having a planar extension and a peripheral portion (45)
(Continued)

extending from the base portion (44), transversally with respect to the planar extension of the base portion (44); and forming in the silicon wafer (40) a plurality of through holes, each defining a respective nozzle (31) for ejection of the ink. The method according to the present invention is characterized in that the silicon wafer (40) is a silicon-on-insulator wafer, wherein the silicon-on-insulator wafer comprises a silicon device layer (38) adjacent to the first surface (41), a silicon handle layer (37) adjacent to the second surface (42) and an insulator layer (39) in-between.

16 Claims, 15 Drawing Sheets

(52) U.S. Cl.
CPC ..... *B41J 2/1628* (2013.01); *B41J 2/1629* (2013.01); *B41J 2/1631* (2013.01); *B41J 2/1632* (2013.01)

(56) References Cited

U.S. PATENT DOCUMENTS

| | | | | |
|---|---|---|---|---|
| 9,971,970 | B1 * | 5/2018 | Rigetti | H01L 27/18 |
| 10,151,041 | B2 * | 12/2018 | Han | C25D 1/10 |
| 2004/0056930 | A1 * | 3/2004 | Tsai | B41J 2/1632 347/68 |
| 2006/0028508 | A1 | 2/2006 | Chen et al. | |
| 2006/0125068 | A1 * | 6/2006 | Abbink | G01P 15/093 257/686 |
| 2007/0019033 | A1 | 1/2007 | Sim et al. | |
| 2011/0242218 | A1 * | 10/2011 | Gulvin | B41J 2/14314 347/47 |
| 2012/0268524 | A1 | 10/2012 | Zhao et al. | |
| 2013/0109113 | A1 * | 5/2013 | Baldi | B41J 2/1603 438/21 |

FOREIGN PATENT DOCUMENTS

| | | |
|---|---|---|
| JP | 2014158037 | 8/2014 |
| WO | 2011154394 | 12/2011 |

OTHER PUBLICATIONS

Japanese Office Action in counterpart Japanese Application No. 2017-544902 dated Mar. 19, 2020 (and English language translation of the Office Action).

* cited by examiner

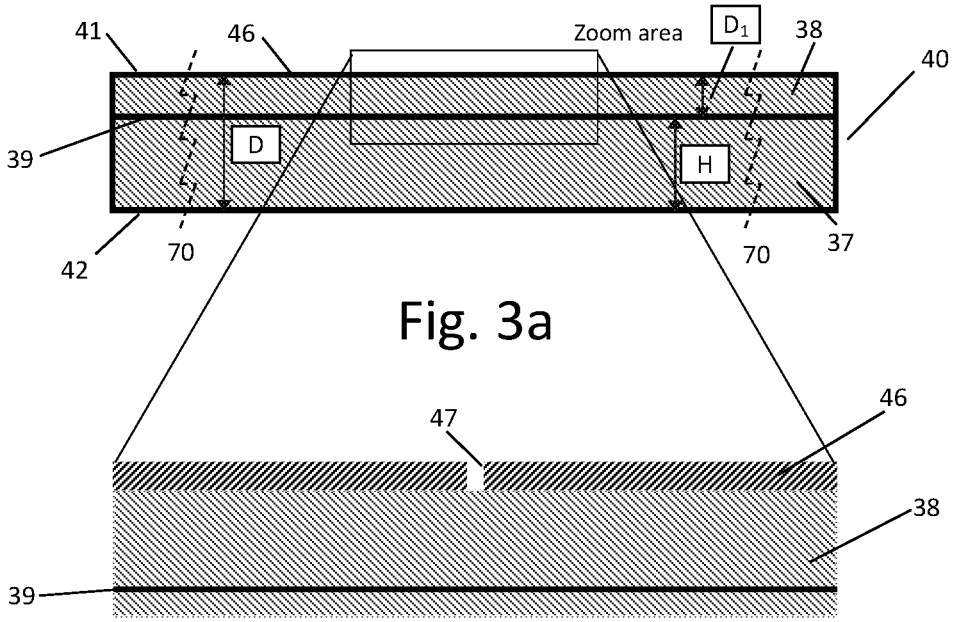
Fig. 3a
Fig. 3b
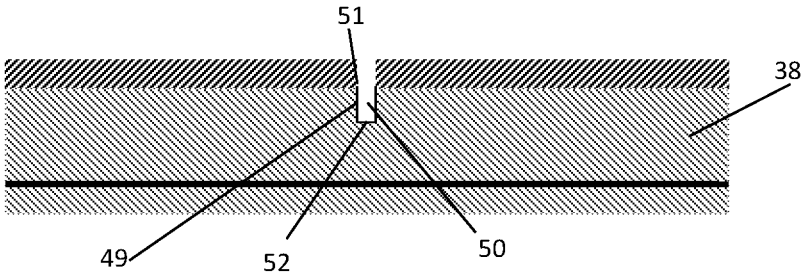
Fig. 3c
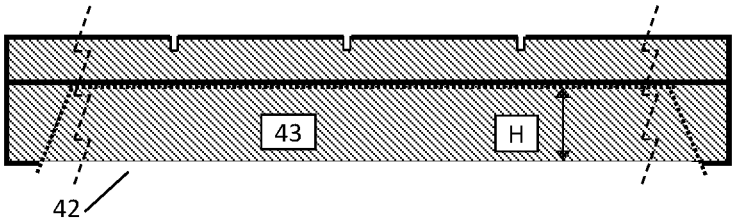
Fig. 3d

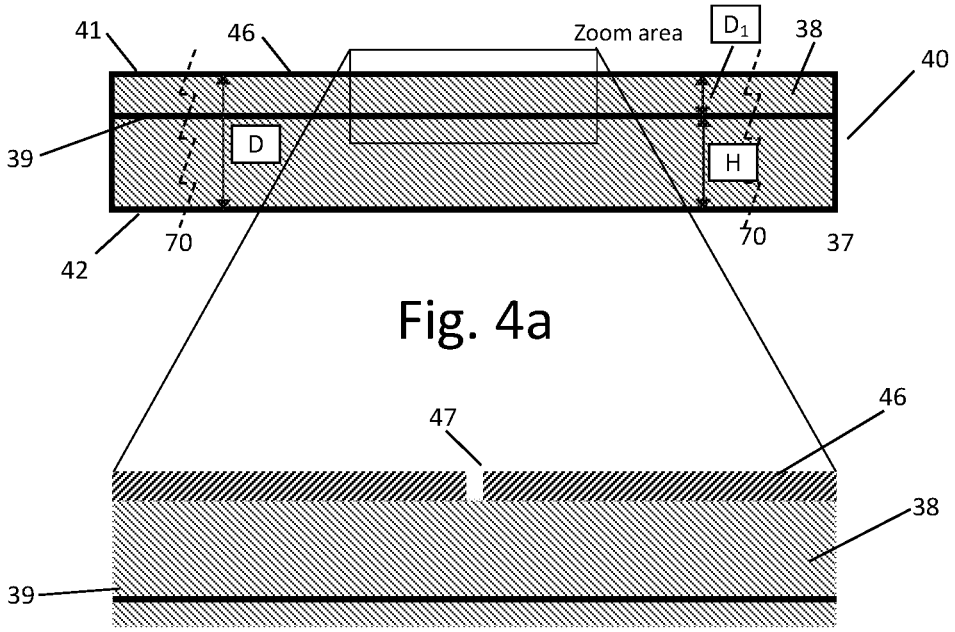
Fig. 4a
Fig. 4b
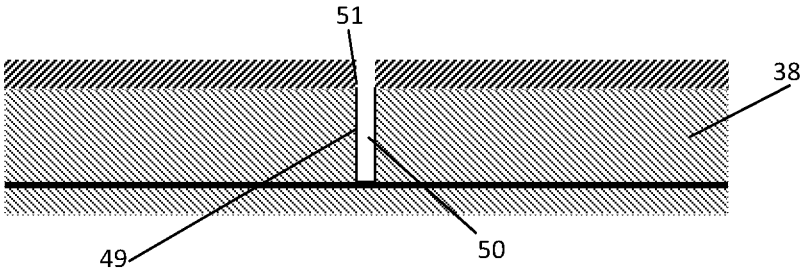
Fig. 4c
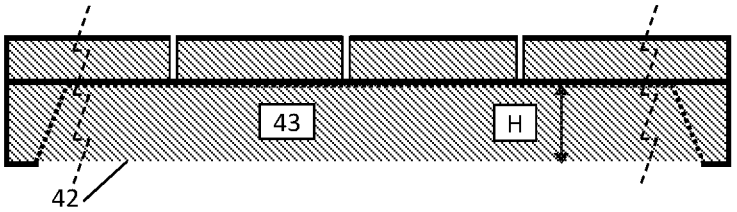
Fig. 4d

METHOD OF MANUFACTURING AN INK-JET PRINTHEAD

TECHNICAL FIELD

The present invention relates to a method of manufacturing an ink-jet printhead. The method comprises providing a silicon substrate including active ejecting elements, providing a hydraulic structure layer for defining hydraulic circuits configured to enable a guided flow of ink, providing a silicon orifice plate having a plurality of nozzles for ejection of the ink, and assembling the silicon substrate with the hydraulic structure layer and the silicon orifice plate. According to this method, providing the silicon orifice plate comprises the steps of providing a silicon wafer having a planar extension delimited by a first surface and a second surface on opposite sides of the silicon wafer, performing a thinning step at the second surface so as to remove from the second surface a central portion having a preset height, the silicon wafer being formed, following the thinning step, by a base portion having a planar extension and a peripheral portion extending from the base portion, transversally with respect to the planar extension of the base portion, and forming in the silicon wafer a plurality of through holes, each defining a respective nozzle for ejection of the ink.

PRIOR ART

WO 2011/154394 A1 discloses a method of manufacturing an ink-jet printhead of the above technical field. The Applicant has verified that using a silicon orifice plate has many advantages over orifice plates made of nickel, which were common before WO 2011/154394 A1.

However, using silicon for making the orifice plate presents some additional problems. In fact the thinner silicon wafers that are commercially available for wafer diameters of 15.24 cm (6 inches) or more usually have a thickness of about 200 μm. This thickness, however, is too high for the wafers to be used to obtain orifice plates through known technologies.

A desired thickness for the wafers would range between 10 μm and 100 μm (for example about 50 μm). However, silicon wafers such a small thickness are usually very difficult to be manufactured and, therefore, extremely expensive. Furthermore, such thin silicon wafers are very difficult to handle, both manually and by automatic systems, in view of their fragility. In WO 2011/154394 A1, the authors presented some methods for realizing such a silicon orifice plate.

According to WO 2011/154394 A1, the method of manufacturing the ink-jet printhead starts from a commercially available silicon wafer (e.g. having a thickness of 200 μm-250 μm) by removing a central portion thereof, so that the remaining structure comprises a base portion having a planar extension, and a peripheral portion extending, from said base portion, transversally with respect to the planar extension of said base portion. The nozzles are formed in the base portion before and/or after the central portion is removed. The peripheral portion allows the silicon wafer to be easily handled by automatic robots in automated manufacturing lines.

Finally, the silicon wafer is cut to obtain a plurality of orifice plates, each of which can be assembled with respective silicon substrate and hydraulic structure layer in order to obtain an ink-jet printhead.

Alternatively, the silicon wafer with the orifice plates could be directly joined to the printhead wafer by means of a wafer bonding process. This wafer bonding can be a direct bonding or an indirect bonding by means of an adhesive layer.

The orifice plate thickness strongly influences the drop mass and the ink refilling phase of the ejection chamber, while the orifice plate shape and the orifice plate surface quality affect the drop ejection behavior. Therefore, obtaining good thickness uniformity across the whole plate is strongly desired.

The method presented in WO 2011/154394 A1 introduces a very critical thickness wafer control procedure which results in a long process time and the difficulty of handling the very weak wafers. For example, it becomes necessary to stop the etching of the central portion area at a fixed process time, close to process end—roughly at a distance lower than 50 microns to the etch end, and verify the thickness of the etched part. The verification gives a precise indication of the finally required process time in order to complete the etching in a perfect way at the desired orifice plate thickness. This makes the manufacturing of the orifice plate very time consuming.

Further, the thinning step of the second surface can introduce surface defects on the final silicon surface, for example if a wet etching solution composition and a bath temperature are not very well controlled or not kept uniform across the whole wafer surface. This can result in problems during many of the next manufacturing method steps, for example dicing or thermo-compression bonding. The thinned surface may correspond to the external nozzle surface and, if it comprises too many defects, this can significantly affect the printing quality.

According to the above, the method known from WO 2011/154394 A1 leaves room for improvement of the manufacturing time of the printhead as well as the surface quality of the surface obtained from the thinning step.

SUMMARY OF THE INVENTION

An object of the present invention is providing a method of manufacturing an ink-jet printhead of the above technical field which can be carried out faster. An additional object of the present invention is providing such a method which allows for more reliably and/or more efficiently providing an ink-jet printhead having a silicon orifice plate, a hydraulic structure layer and a silicon substrate. A further object of the present invention is providing such a method which avoids surface defects of the silicon orifice plate which could affect the printing quality obtained from the printhead.

This object is solved by the method of claim 1. Advantageous further features and embodiments of the invention are subject to the dependent claims.

According to the invention, the method of manufacturing an ink-jet printhead comprising providing a silicon substrate including active ejecting elements, providing a hydraulic structure layer for defining hydraulic circuits configured to enable a guided flow of ink, providing a silicon orifice plate having a plurality of nozzles for ejection of the ink, assembling the silicon substrate with the hydraulic structure layer and the silicon orifice plate, wherein providing the silicon orifice plate comprises providing a silicon wafer having a planar extension delimited by a first surface and a second surface on opposite sides of the silicon wafer, performing a thinning step at the second surface so as to remove from the second surface a central portion having a preset height, the silicon wafer being formed, following the thinning step, by a base portion having a planar extension and a peripheral portion extending from the base portion, transversally with respect to the planar extension of the base portion and forming in the silicon wafer a plurality of through holes, each defining a respective nozzle for ejection of the ink is characterized in that the silicon wafer is a silicon-on-insulator (SOI) wafer, wherein the SOI wafer comprises a silicon device layer adjacent to the first surface, a silicon handle layer adjacent to the second surface and an insulator layer in-between.

In other words, the orifice plate is realized according to the process described in WO 2011/154394 A1 but starting with a commercial silicon-on-insulator (SOI) wafer.

The inventors have found out that the thickness of the so-called "device layer" of the SOI wafer can be selected on-demand and is also very well controlled by the manufacturer. The resulting thickness of the final silicon orifice plate turns out to be very uniform and free of defects.

Preferably, a thickness of the handle layer is between 100 μm and 1000 μm. The preferably thinner silicon "device layer" can have a thickness of between about 1 μm and up to the desired thickness 300 μm, further preferably a thickness of between 10 μm and 100 μm, further preferably about 50 μm. The insulator layer, which is also referred to as "buried layer", "buried oxide layer", "buried insulator layer" or "buried insulating layer", preferably has a thickness of up to a few microns, preferably a thickness of 1 μm to 5 μm, and is preferably made of silicon oxide (SiO) or silicon dioxide (SiO2).

By applying the proposed method, the device layer thickness can directly determine the final thickness of the obtained orifice plate, thereby avoiding any long lasting thickness check procedure as usually required in the prior art. In fact, the buried oxide of the SOI wafer acts as a stop layer for the thinning process, due to the etching selectivity with respect to a silicon oxide material.

Further, after a preferred step of selectively removing the insulator layer, the resulting silicon surface is free of defects, particularly if the insulator layer is a layer comprising silicon oxide or silicon dioxide because the oxide etching process for at least partially removing the insulator layer is selective with respect to silicon so that the silicon device layer is not affected by the step of selectively removing the insulator layer. On the other hand, a thinning step of removing the central portion from the second surface is selective with respect to the insulator layer so that the insulator layer is not affected by the step of thinning the SOI wafer.

The silicon orifice plate produced by this process is very uniform in thickness and free of surface defects, solving the above mentioned problems of the prior art.

Preferably, the silicon wafer undergoes a dicing step, wherein it is cut and a plurality of orifice plates, including the mentioned orifice plate, is obtained.

Alternatively, the silicon wafer having the orifice plates can be directly joined to the printhead wafer, in particular the hydraulic structure layer, by means of a wafer bonding process. This wafer bonding can be a direct bonding or an indirect bonding by means of an adhesive layer.

Further alternatively, the silicon device layer of the silicon-on-insulator wafer having the orifice plates can be separated from the handle layer by wafer thinning after temporary bonding of the device layer to a further handle substrate, e.g. wafer, tape or other further substrate. The temporary bonding between the silicon-on-insulator wafer and the handle substrate could be obtained from a temporary bonding adhesive, e.g. of the thermal-release type or of the solvent-release type.

The final thinning step could be realized both by silicon wet etching and silicon dry etching or by grinding which can eventually be completed by dry etching or wet etching. The buried layer will guarantee the final nozzle plate thickness.

Further features and advantages of the present invention will become more apparent from the detailed description of preferred, not limiting, embodiments of a method of manufacturing an ink-jet printhead in accordance with the present invention.

BRIEF DESCRIPTION OF THE DRAWINGS

The invention description will be set out hereinafter with reference to the accompanying drawings, given by way of non-limiting example, in which:

FIGS. 3*a*-3*g* schematically show exemplary steps carried out in a first embodiment of the method of manufacturing an ink-jet printhead;

FIGS. 4*a*-4*g* schematically show exemplary steps carried out in a second embodiment of the method of manufacturing an ink-jet printhead;

DETAILED DESCRIPTION OF PREFERRED EMBODIMENTS

Figure 1:
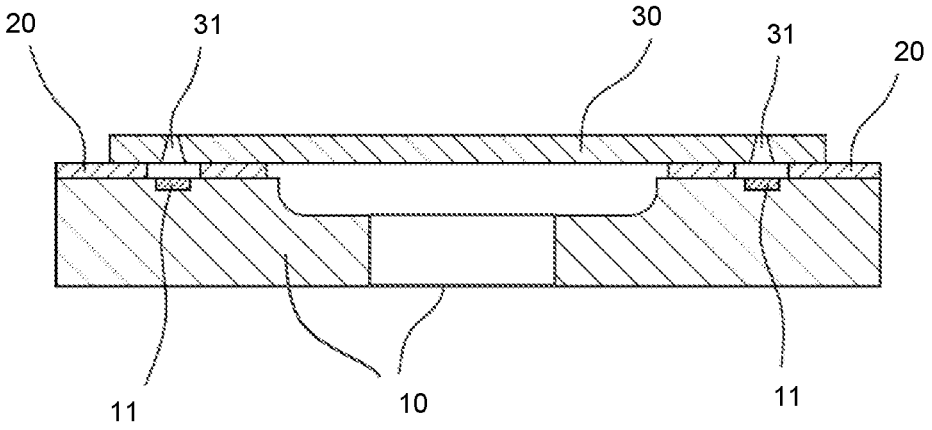
FIG. 1 schematically shows a cross-sectional view of a print head of the technical field of the present invention.

With reference to the drawings, a printhead manufactured according to the method of the present invention has been generally denoted as printhead 1.

The method according to the invention comprises a step of providing a silicon substrate 10 including active ejecting elements 11. Preferably, the active ejecting elements 11 are heating elements: they heat the ink in order to cause generation of ink droplets and ejection of the same through nozzles 31. In this case, the printhead 1 is a thermal ink-jet printhead. In an alternative embodiment, the active ejecting elements 11 are piezoelectric elements that are electrically actuated in order to displace a membrane and consequently push the ink out of the nozzles 31, causing ejection of the same. In such embodiment, the printhead 1 is a piezoelectric ink-jet printhead.

The silicon substrate 10 may also include an electric circuit (not shown) that is configured to properly and selectively command the active ejecting elements 11 so that ink is ejected on a determined medium to be printed, according to preset patterns. The electric circuit can, however, also be located elsewhere.

The method according to the invention further comprises a step of providing a hydraulic structure layer 20 for defining hydraulic circuits through which the ink flows which means that it is configured to enable a guided flow of ink.

Preferably, the hydraulic structure layer 20 is a polymeric film whose thickness can be comprised between 10 μm and 200 μm.

Further preferably, the hydraulic structure layer 20 defines ejection chambers, in which the ink is subjected to the action of the active ejecting elements 11, and feeding channels that guide the ink to the ejection chambers. Preferably, the ink is stored in a reservoir and reaches the feeding channels through an ink feed slot (not shown).

The method according to the invention further comprises a step of providing a silicon orifice plate 30 having a plurality of nozzles 31 for ejection of the ink droplets.

Figure 9:
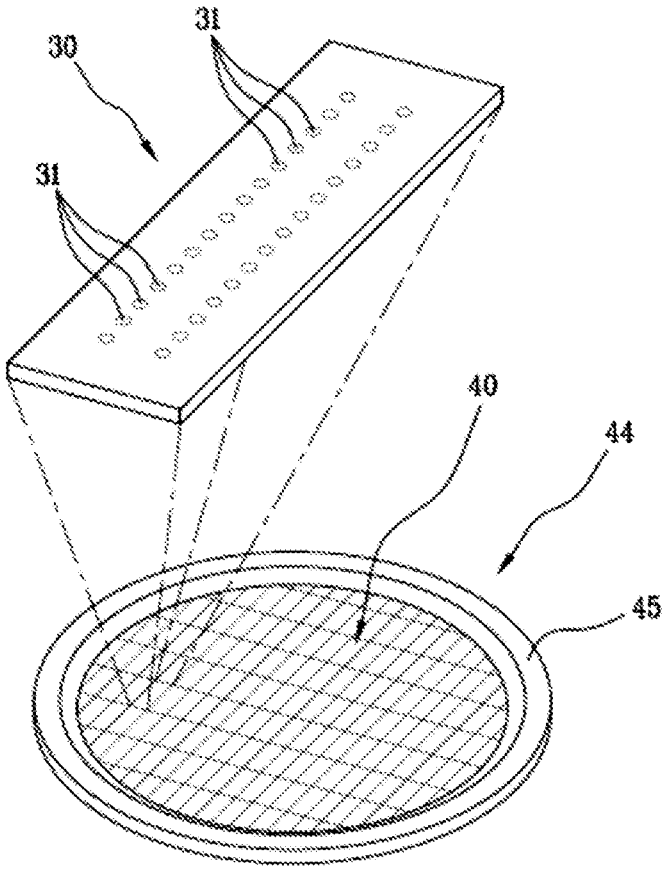
FIG. 9 schematically shows a silicon wafer after a thinning step carried out according to the embodiments of the method of manufacturing an ink-jet printhead and an enlarged view of a single nozzle plate.

Preferably, a plurality of silicon orifice plates 30 is obtained from one silicon wafer 40 (see FIG. 9). After the nozzle formation, the orifice plates 30 are separated from each other, preferably through a dicing step. Subsequently, each orifice plate 30 is aligned with and mounted on a respective silicon substrate 10.

In the present context, the orifice plate 30 is preferably obtained as briefly indicated here above. As shown in FIG. 1, the silicon substrate 10, the hydraulic structure layer 20 and the orifice plate 30 comprising the nozzles 31 are assembled, so as to form the printhead 1. Preferably, the assembly step is performed so that the hydraulic structure layer 20 is located between the silicon substrate 10 and the silicon orifice plate 30.

Preferably, the assembly step comprises a thermo-compression sub-step, wherein the silicon substrate 10, the hydraulic structure layer 20 and the orifice plate 30 are pressed (pressure comprised, for example, between 1 bar and 10 bar) and, at the same time, heated (temperature comprised, for example, between 150° C. and 200° C.). The duration of the thermo-compression sub-step can vary from a few minutes to a couple of hours. In more detail, the orifice plate 30 can be obtained as follows.

A silicon-on-insulator wafer 40 is provided that has a substantially planar extension delimited by a first surface 41 and a second surface 42 on opposite sides of the wafer 40. A substantially planar extension is, in the context of the present application, an extension which, in a thickness direction of the wafer, does not deviate from a mathematical plane to an extent of more than 5% of its largest lateral dimension. Preferably, the first surface 41 and the second surface 42 comprise or, preferably, consist of silicon oxide of a thickness of between 100 nm and up to a few microns, but also other materials could be conveniently used for forming the first and second surfaces 41, 42 such as silicon nitride, silicon carbide and the like, or a suitable photoresist material. Preferably, the first and second surfaces 41, 42 are substantially parallel to each other, which means that an angle between the first surface 41 and the second surface 42 is 5° or less, preferably 1° or less.

The first and second surfaces 41, 42 are separated by a distance D. The silicon-on-insulator wafer 40 can have a thickness of, for example, between slightly above 100 μm and up to 380 μm. Preferably, the silicon-on-insulator wafer 40 can be 200 μm thick.

In general, a silicon-on-insulator (SOI) wafer comprises three different layers: a handle layer 37 made of silicon, a thickness H of which usually ranges from 100 μm to 1000 μm, a device layer 38 made of silicon which is much thinner than the handle layer 37 and can have a thickness of as small as 1 μm or even slightly below. Further, the SOI comprises a buried insulating layer 39, a thickness of which is usually up to a few microns, in between. The insulator layer 39 can usually be made of silicon oxide but also other insulating materials, such as silicon nitride or silicon carbide, can be chosen for the insulator layer 39.

According to the invention, a thinning step is performed at the second surface 42 of the silicon wafer 40. In this way, a central portion 43 having a preset height H is removed. The preset height H is equal to the thickness, or height, of the handle layer 37 of the SOI wafer 40. Preferably, the height H can be comprised between 100 μm and 360 μm. Particularly preferably, the height H can be comprised between 120 μm and 160 μm.

After the thinning step, the silicon-on-insulator wafer 40 is formed by a base portion 44, having a planar extension, and a peripheral portion 45, that extends from the base portion 44 transversally with respect to the planar extension of the same base portion 44. The shape of the silicon wafer 40 at this stage is schematically shown in FIG. 9. Preferably, the outer surface of the peripheral portion 45 extends from the base portion 44 perpendicularly with respect to the planar extension of the base portion 44.

Figure 3E:
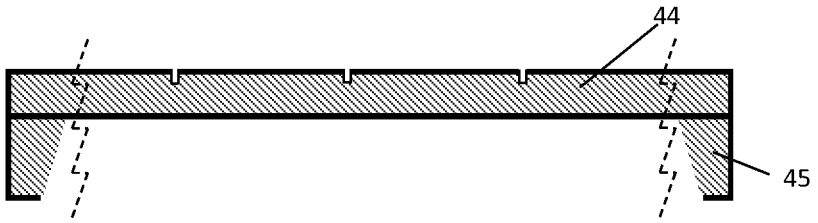
Figure 3F:
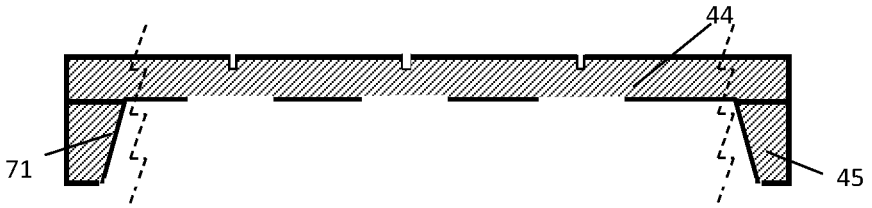

In practice, after the thinning step, the silicon-on-insulator wafer 40 has a ring structure as is illustrated for example in FIGS. 3*f* and 9. In other words, by means of the thinning step, the thickness of the silicon-on-insulator wafer 40 is reduced, apart from the peripheral portion 45, the thickness of which remains substantially unchanged with respect to the initial thickness of the silicon-on-insulator wafer 40. The silicon-on-insulator wafer 40 thus shaped can be easily handled by hand and/or by automatic systems in automated manufacturing lines due to the relatively thick peripheral portion 45 and, at the same time, can be used to obtain sufficiently thin orifice plates 30 from the inner part of the wafer 40. Accordingly, the peripheral portion 45 can be used as a "handling portion".

A plurality of through holes, each defining a respective nozzle 31 for ejection of the ink, is formed in the wafer 40.

As mentioned above, the orifice plate 30 is preferably obtained through a dicing step wherein the silicon-on-insulator wafer 40, after formation of the nozzles 31, is cut to obtain a plurality of orifice plates. FIG. 9 schematically shows how the silicon-on-insulator wafer 40 includes a plurality of orifice plates 30. Alternatively, the wafer 40 with the orifice plates 30 could be directly joined to the hydraulic structure layer and silicon substrate by means of a wafer bonding process. This wafer bonding can be a direct bonding or an indirect bonding by means of an adhesive layer.

Alternatively, the silicon device layer 38 of the silicon-on-insulator wafer 40 for obtaining the orifice plates could be separated from the handle layer 37 by wafer thinning after temporary bonding of the device layer 38 to a further handle substrate such as a wafer, tape or similar means. The temporary bonding between the silicon-on-insulator wafer 40 and the handle substrate could be obtained by a temporary bonding adhesive of the thermal-release type or the solvent-release type. The final thinning step could be realized both by silicon wet etching and silicon dry etching or also by grinding or by chemical-mechanical polishing, eventually completed with a silicon dry or wet etching. The insulator layer 39 will guarantee the final nozzle plate thickness.

In particular, the orifice plate 30 is obtained as a portion of the base portion 44. Preferably, by means of the dicing step, the orifice plate 30 is separated from other possible orifice plates formed on the same silicon-on-insulator wafer 40, and from the peripheral, or handling, portion 45.

Applying the proposed process flow starting from the device layer of the silicon-on-insulator wafer 40, a device layer thickness D1 can directly determine the final thickness of the orifice plate obtained. More in detail, the device layer thickness D1 which corresponds to the difference between the aforementioned distance D, i.e. the distance between the first and second surfaces 41, 42, and the height H of the central portion 43, i.e. the portion removed by means of the thinning step, defines a longitudinal length L of the nozzles 31 of the orifice plate 30.

In other terms, the longitudinal length L of the nozzles 31 is substantially equal to the thickness of the base portion 44, which is equal to the device layer thickness D1 of the SOI wafer 40. Without the use of the silicon-on-insulator wafer, this would mean that the height H of the central portion 43 should be determined so that, after the thinning step, the remaining base portion 44 of the silicon wafer 40 has a thickness that defines the longitudinal length L of the nozzles 31. While applying the proposed method, the device layer thickness D1 of the silicon-on-insulator wafer 40 can directly determine the final thickness of the obtained orifice plate, thus avoiding the long lasting thickness check procedure of the prior art. In fact, the insulator layer 39 of the SOI wafer 40 acts as a stop layer for the thinning process, due to the etching selectivity with respect to an insulator material, in particular silicon oxide or silicon dioxide.

Moreover, after the preferred subsequent step of removing the insulator layer 39, the resulting silicon surface is free of defects because the oxide etching process is in turn selective with respect to the silicon so that the surface of the silicon device layer acts as a stop layer for the mechanism removing the insulator.

Advantageously, the thinning step can be performed by etching. Preferably, the thinning etching step is a wet-etching step. Alternatively, a reactive ion etching process or a dry-etching process could be applied for the thinning step. In both cases, the insulator layer process, due to the etching selectivity with respect to a silicon oxide material.

Preferably, the thinning step comprises the following sub-steps:

- masking material deposition of at least the second surface 42; preferably, the masking is performed through an oxidation process which is carried out on the whole silicon-on-insulator wafer 40. Thus, on at least the second surface 42, and preferably on the whole silicon wafer 40, a layer of oxide is formed;
- protection of an external ring on the second surface 42, in particular on a peripheral zone, corresponding to the peripheral portion 45 to be obtained; this protection could be obtained by means of a photolithographic masking process, a protective tape, or by using a wafer holder. It is to be noted that the wafer holder may protect not only the mentioned external ring, but also the wafer back side during the etching of the masking material. Thus such etching is not necessarily of the dry type, but it can be, under these circumstances, of the wet type;
- removal of the portion of the masking material that is not covered by the protection;
- removal, preferably by means of a wet-etching action, the central portion 43, i.e. the portion of silicon wafer that is not covered by the masking layer;
- at least partial removal of the masking material layer.
- at least partial removal of the buried oxide, i.e. the insulator layer 39.

Alternatively, the thinning step can be performed by reactive ion etching, dry etching, mechanical grinding or chemical-mechanical polishing. In case of grinding, a grinding wheel operated by a grinding machine provides the removal of the central portion 43 without the need for any protection and/or oxide layer. A polishing step is usually performed after the grinding step to remove the grinding marks and the subsurface cracks generated during the grinding step.

A preferred method further comprises a step of forming in the device layer 38 of the silicon-on-insulator wafer 40 a plurality of through holes, each defining a respective nozzle 31 for ejection of the ink. Preferably the through holes are formed in the base portion 44.

It has to be noted that, in the described preferred embodiments, each nozzle 31 is formed before the thinning step. The nozzle geometry should be selected in order to reduce the resistance to ink flow as well as to improve the uniformity of the nozzle across the micro-electromechanical device.

Trapping of air can also be reduced or eliminated by nozzle geometry. Preferably each nozzle 31 comprises a top portion 32 and a bottom portion 33, the latter being axially aligned to the top portion 32. In the present context, "top" and "bottom" refer to the position of the nozzle's portions with respect to the printhead wafer on which the nozzle plate is mounted: the "bottom" portion is closer to and directly facing the hydraulic structure layer 20, whereas the "top" portion is farther from the hydraulic structure layer 20.

The top cross section of the top portion 32 can be square, circular or differently shaped.

The bottom portion 33 can have a rectangular or round top cross section. Preferably the top portion 32 of each nozzle has a substantially cylindrical shape. Preferably the bottom portion 33 of each nozzle 31 has a substantially frusto-pyramidal shape.

The longitudinal length L of the nozzle 31 is defined by the longitudinal length of the top portion 32 plus the height of the bottom portion 33. Preferably the top portions 32 of the nozzles 31 of the orifice plate 30 are obtained by means of an etching step that will be referred to as top portion etching step. Preferably the top portion etching step is a dry-etching step.

In the described preferred embodiment, the top portion etching step, preferably a dry-etching step, is carried out, wherein a plurality of substantially cylindrical cavities 50 is formed in the device layer 38 of the silicon-on-insulator wafer 40 at its first surface 41. At least a part of each of the substantially cylindrical cavities 50 defines the top portion 32 of a respective nozzle 31. Each substantially cylindrical cavity 50 has a first longitudinal end 51 at the first surface 41 of the silicon-on-insulator wafer 40, and a second longitudinal end 52 opposite to the first longitudinal end 51.

Preferably the bottom portions 33 of the nozzles 31 of the orifice plate 30 are obtained by means of an etching step that will be referred to as bottom portion etching step.

Preferably the bottom portion etching step is an anisotropic wet-etching step.

Figure 2:
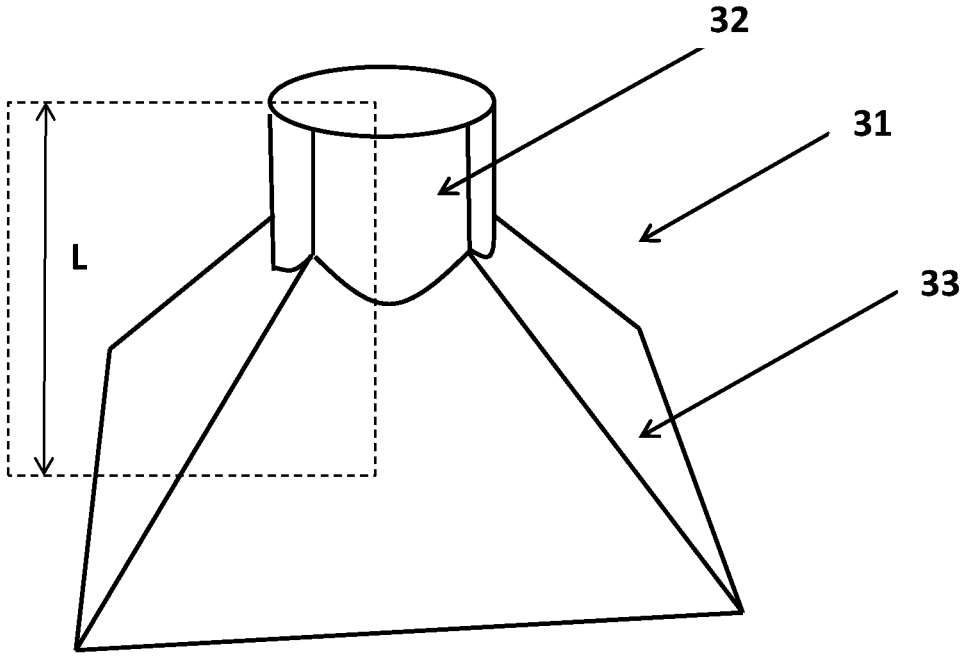
FIG. 2 schematically shows a detail of FIG. 1 relating to the shape of a nozzle.

In the embodiments of FIGS. 3, 4 and 5, the bottom portion etching step, preferably an anisotropic wet-etching step, is carried out, wherein a plurality of bottom portions 33, preferably having a frusto-pyramidal shape, are formed at the second end 52 of each of the substantially cylindrical cavities 50, thereby obtaining the nozzles 31 of the orifice plate 30, as illustrated in FIG. 2.

Figure 6A:
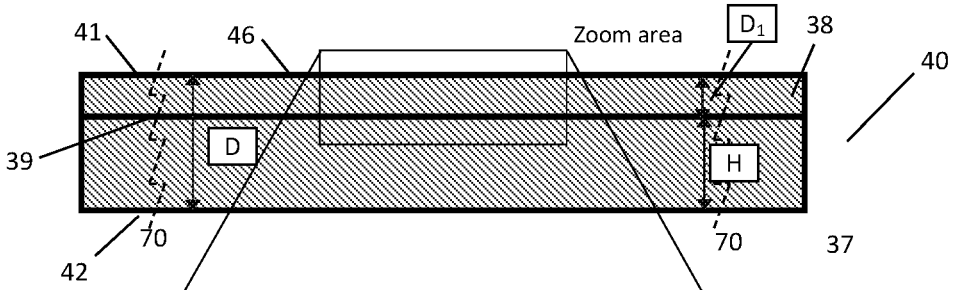
FIGS. 6*a*-6*i* schematically show exemplary steps carried out in a fourth embodiment of the method of manufacturing an ink-jet printhead.
Figure 6B:
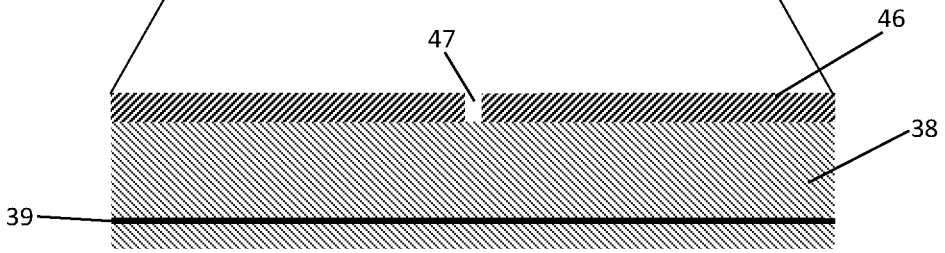
Figure 6C:
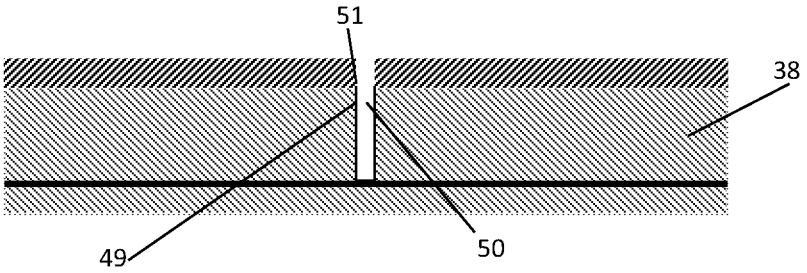
Figure 6D:
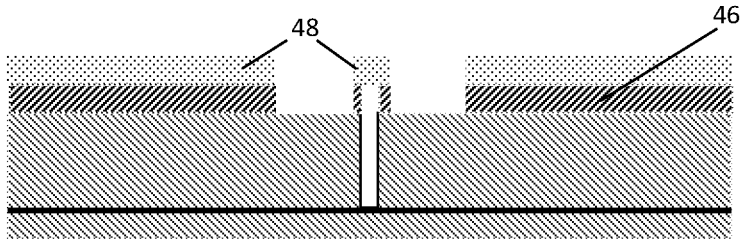
Figure 6E:
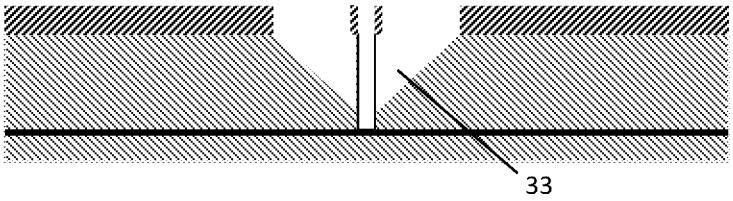
Figure 6F:
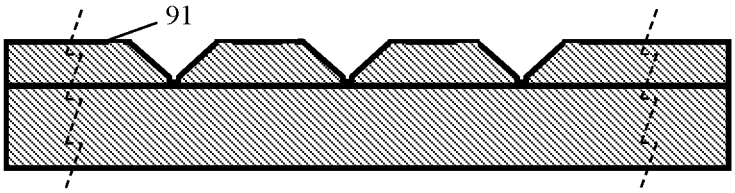
Figure 6G:
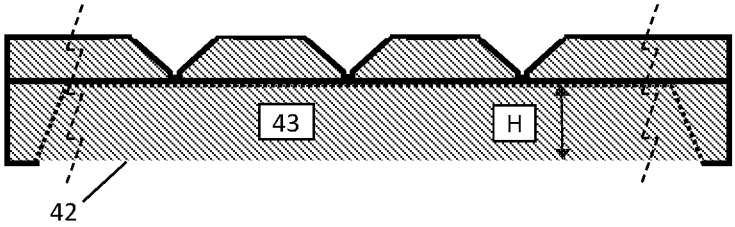
Figure 6H:
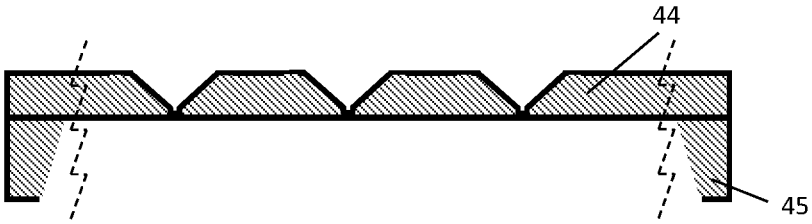
Figure 6I:
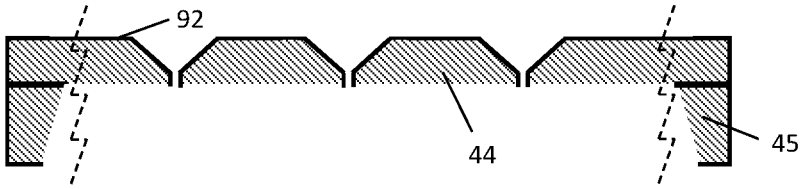
Figure 7A:
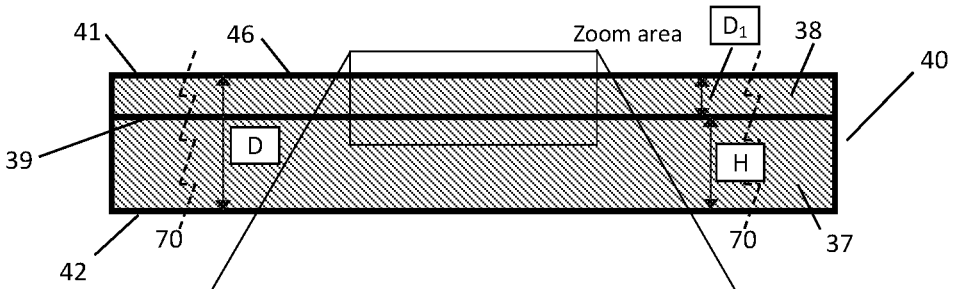
FIGS. 7*a*-7*l* schematically show exemplary steps carried out in a fifth embodiment of the method of manufacturing an ink-jet printhead.
Figure 7B:
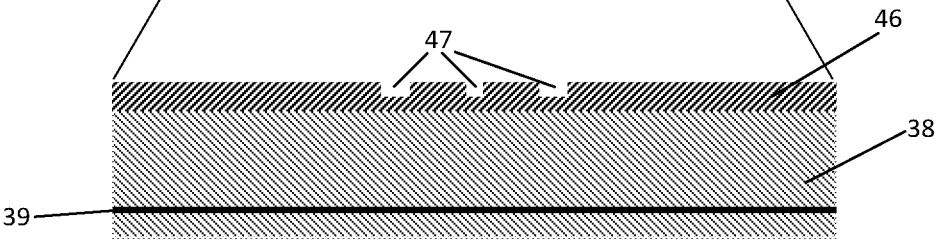
Figure 7C:
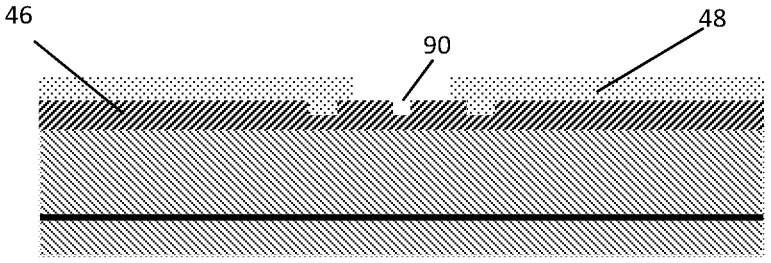
Figure 7D:
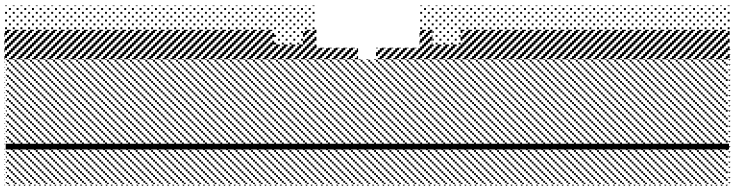
Figure 7E:
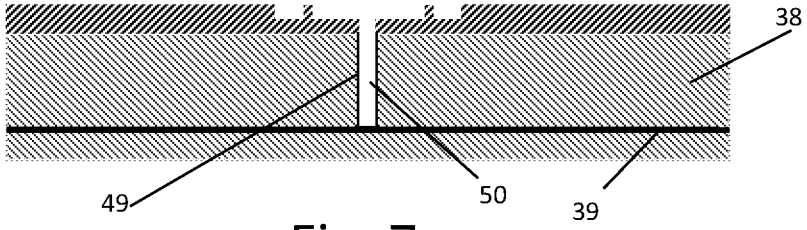
Figure 7F:
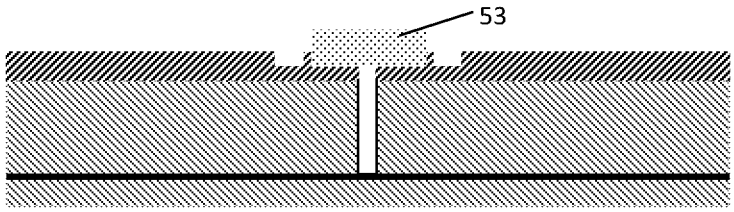
Figure 7G:
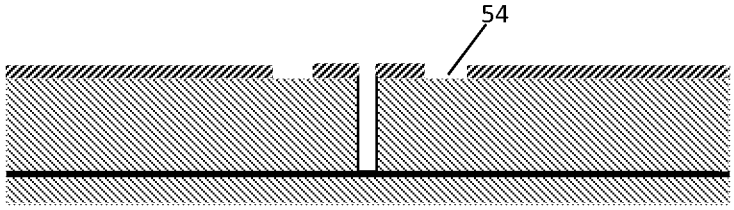
Figure 7H:
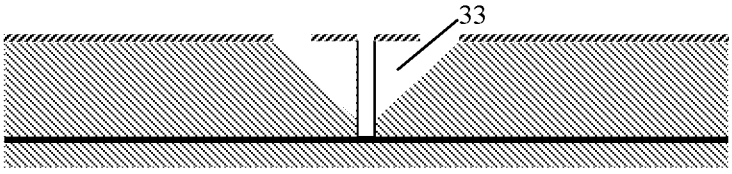

In the embodiment of FIGS. 6 and 7, the bottom portion etching step, preferably an anisotropic wet-etching step, is carried out, wherein a plurality of bottom portions 33, preferably having a frusto-pyramidal shape, are formed at the first end 51 of each of the substantially cylindrical cavities 50, thereby obtaining the nozzles 31 of the orifice plate 30, as illustrated e.g. in FIGS. 2 and 7*h*.

Alternatively, as described in the embodiment of FIG. 8, the nozzle 31 only comprises only a single portion 34. In such a case the nozzles 31 preferably have a frusto-pyramidal shape as described above in relation to the bottom portion etching step. Preferably the nozzle etching step is an anisotropic wet-etching step.

It has to be noted that both the top portion etching step, the bottom portion etching step and the nozzle etching step preferably include sub-steps of oxidation, masking, in particular deposition of a photoresist film, removal of the oxide not covered by the photoresist film, removal of the silicon not covered by the oxide, and removal of the remaining photoresist film and oxide. The method may also comprise a masking step of the top portion etching step with a first mask and a masking step of the bottom portion etching step with a second mask, wherein both of the first and second masking steps are carried out on the first surface. It is also possible that an alignment of the top portion etching step and the bottom portion etching step is performed with a single mask on the first surface.

These kinds of processes are known in the art and, therefore, will not be disclosed in further detail.

In the embodiments of FIGS. 3, 4 and 5, the thinning step is carried out after the top portion etching step and before the bottom portion etching step.

In the embodiment of FIGS. 6 and 7, the thinning step is carried out after the top portion etching step and the bottom portion etching step. In the embodiment of FIG. 8, the thinning step is carried out after the nozzle etching step.

In more detail, in the first embodiment illustrated in FIG. 3, the longitudinal length of the substantially cylindrical cavities 50 is substantially equal to the length of the top portions 32 of the respective nozzles 31. Therefore the longitudinal length of the substantially cylindrical cavities 50 is shorter than the thickness of the base portion 44, in other words shorter than the thickness of the device layer 38.

In the second, fourth and fifth embodiments, illustrated in FIGS. 4, 6 and 7, respectively, the longitudinal length of the substantially cylindrical cavities 50 is equal to the thickness of the base portion 44, in other words equal to the thickness of the device layer 38. In particular in the second embodiment, this feature is advantageous because the top portion etching step is performed at the first surface 41 of the SOI wafer 40, and the bottom portion etching step is performed at the second surface 42 of the SOI wafer. Thus the second end 52 of the substantially cylindrical cavity 50 that is visible from the second surface 42 through the insulator layer after the thinning step can be used as a positional reference for a masking step of the bottom portion etching step, so that the bottom portion 33 can be formed according to a proper alignment with the respective top portion 32.

In the fourth embodiment, illustrated in FIG. 6, this feature is advantageous because the mask used in the bottom portion etching step is aligned using a feature present on the same first surface 41. Therefore, the substantially cylindrical cavity 50 has to be sufficiently long to be equal to the thickness of the base portion 44, in other words equal to the thickness of the device layer 38, in order to obtain an actual through hole.

In the fifth embodiment, illustrated in FIG. 7, this feature is similarly advantageous because such an embodiment has the further advantage of using only one mask for defining the top and bottom portions on the same first surface 41. Therefore the substantially cylindrical cavity 50 has to be sufficiently long. Its length preferably is equal to the thickness of the base portion 44 or, in other words, equal to the thickness of the device layer 38, in order to obtain an actual through hole.

Preferably, as schematically shown in FIG. 5, the method of manufacturing an ink-jet printhead according to the third embodiment comprises a forming step (FIG. 5*b*), wherein one or more reference cavities 60, having a length equal to the thickness of the base portion 44, in other words equal to the thickness of the device layer 38, is formed at the first surface 41. In particular, the forming step is carried out before the thinning step. Likewise, the longitudinal length of the substantially cylindrical cavities 50 can be substantially equal to the length of the top portion 32 of the nozzles 31. The positional reference for the masking step included in the bottom portion etching step is provided by the reference cavities 60 that are visible from the second surface 42 of the SOI wafer 40 through the silicon oxide layer, after the thinning step has been carried out and before the bottom portion etching step is carried out.

Preferably, after the nozzles 31 have been formed and the thinning step has been carried out, the silicon wafer 40 is cut in separate portions, each defining a respective orifice plate. The orifice plate 30 of the printhead 1 will be one of the orifice plates obtained from the silicon-on-insulator wafer 40.

Alternatively, the silicon wafer with the nozzle plates could be directly joined to the printhead wafer by means of a wafer bonding process. This wafer bonding can be a direct bonding or an indirect bonding by means of an adhesive layer.

It has to be noted that in many figures a couple of interruption symbols 70 is present to indicate that the distance between the nozzles 31 and the radially external portion 45 of the silicon wafer 40 may be much greater than shown. In practice, a large number of nozzles 31 are formed in the silicon wafer 40; for sake of clarity, only a couple of them are shown in the drawings.

First Embodiment

FIGS. 3*a*-3*g* schematically show the basic method steps of the first embodiment with the preferred process choice. In the first embodiment, silicon oxide is used as masking layer on both surfaces 41,42 of the SOI wafer 40. In the method step of FIG. 3*a*, a silicon-on-insulator wafer 40 is provided; a silicon oxide layer 46, is formed on the external surface of the silicon-on-insulator wafer 40, preferably through thermal oxidation.

In the method step of FIG. 3*b*, which shows an enlarged view of an area of FIG. 3*a*, through a first lithographic process and subsequent etching, preferably a dry etching, a plurality of portions of silicon oxide are removed from the first surface 41. Each area from which the oxide is removed will correspond to a respective nozzle.

In the method step of FIG. 3*c*, a silicon dry-etching process, the "top portion etching step" referred to above, is performed so that the substantially cylindrical cavities 50 are formed.

In this embodiment, the longitudinal length of the cylindrical cavities 50 is substantially equal to the longitudinal length of the top portions 32, preferably having a substantially cylindrical shape, of the nozzles 31. Then, another oxidation process is carried out so as to cover also the surface of the substantially cylindrical cavities 50 with a layer of silicon oxide. In the method step of FIG. 3*d*, an oxide etching is performed in order to remove, from the second surface 42, a central portion of oxide. The protection of the external ring could be obtained by means of a photolithographic masking process, a protective tape, or by using a wafer holder. Preferably, this oxide etching process is performed by means of wet-etching.

In the method step of FIG. 3*e*, the "thinning step" is performed, wherein the central portion 43 of the silicon-on-insulator wafer 40 is removed acting on the second surface 42 through a silicon wet-etching, alternatively by grinding or dry etching. As a consequence, the silicon-on-insulator wafer 40 is now formed by the base portion 44 and the peripheral portion 45.

Another oxidation process is carried out, so that the sloping surfaces 71 of the peripheral portion 45 are covered with a layer of silicon oxide. In the method step of FIG. 3*f*, through a combination of lithographic process and oxide dry etching, portions of oxide, the insulator layer 39 of the SOI, are removed where the nozzles 31 are supposed to be formed, i.e. at positions corresponding to the already formed substantially cylindrical cavities 50.

Figure 3G:
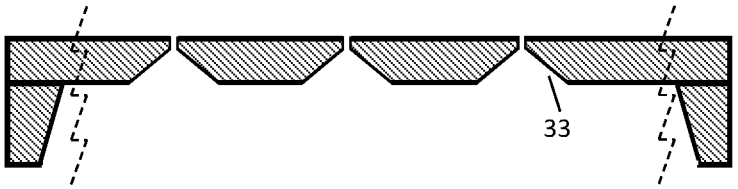

In the method step of FIG. 3*g*, a silicon anisotropic wet-etching process, the "bottom portion etching step" mentioned above, removes frusto-pyramidal portions of silicon where the oxide, the insulator layer 39, has been removed so as to form the bottom portions 33, preferably having a frusto-pyramidal shape, of the nozzles 31. Later on, an oxide wet-etching is performed in order to remove the layer of oxide that separates each substantially cylindrical cavity 50 with the respective bottom portion 33, preferably having a frusto-pyramidal shape, and complete the formation of the nozzles 31. Finally, if required, another oxidation step can be carried out, to cover the whole structure with a layer of oxide.

Second Embodiment

FIGS. 4*a* to 4*g* schematically show the basic method steps of the second embodiment. In the second embodiment, silicon oxide is used as masking layer on both surfaces of the SOI wafer.

In the method step of FIG. 4*a*, a silicon-on-insulator wafer 40 is provided. A silicon oxide layer 46, is formed on the external surface of the silicon-on-insulator wafer 40, preferably through thermal oxidation.

In the method step of FIG. 4*b*, which shows an enlarged view of a part of FIG. 4*a*, through a first lithographic process and subsequent etching, preferably a dry etching, a plurality of portions of silicon oxide is removed from the first surface 41. Each area from which the oxide is removed will correspond to a respective nozzle.

In the method step of FIG. 4*c*, a silicon dry-etching process is performed, the "top portion etching step" referred to above, so that the substantially cylindrical cavities 50 are formed. In this embodiment, a longitudinal length of the cylindrical cavities 50 is substantially equal to the thickness of the base portion 44, in other words equal to the thickness of the device layer 38. Then, another oxidation method is carried out so as to cover also the surface of the substantially cylindrical cavities 50 with a layer of silicon oxide 49.

In the method step of FIG. 4*d*, an oxide etching is performed in order to remove, from the second surface 42, a central portion of oxide. The protection of the external ring could be alternatively obtained by means of a photolithographic masking method, by a protective tape or by using a wafer holder. Preferably, this oxide etching process is performed by means of wet-etching.

Figure 4E:
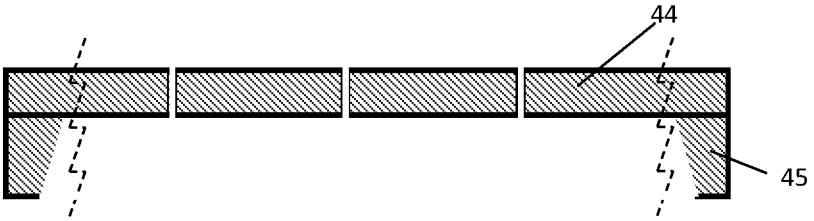

In the method step of FIG. 4*e*, the "thinning step" is performed, wherein the central portion 43 of the silicon-on-insulator wafer 40 is removed, acting on the second surface 42 through a silicon wet-etching, alternatively by grinding or dry etching. As a consequence, the silicon-on-insulator wafer 40 is now formed by the base portion 44 and the peripheral portion 45. Further, another oxidation process is carried out, so that the sloping surfaces 71 of the peripheral portions 45 are covered with a layer of silicon oxide.

It has to be noted that the substantially cylindrical cavities are now through holes that are visible also from the second surface 42, through the buried oxide of the insulator layer 39. This feature is advantageous because it provides a clear, precise and reliable visual reference for the formation of the frusto-pyramidal portions of the nozzles starting from the backside, i.e. from the side of the second surface 42.

Figure 4F:
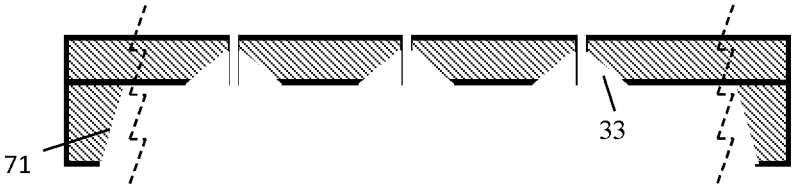

In the method step of FIG. 4*f*, through a combination of lithographic process and oxide dry etching, portions of oxide, the oxide of the insulator layer 39, are removed where the nozzles 31 are supposed to be formed, i.e. at positions corresponding to the already formed substantially cylindrical cavities 50. Further, a silicon anisotropic wet-etching process, the "bottom portion etching step" mentioned above, removes frusto-pyramidal portions of silicon where the oxide, the oxide of the insulator layer 39, has been removed so as to form the bottom portions 33 of the nozzles 31, preferably having a frusto-pyramidal shape.

Figure 4G:
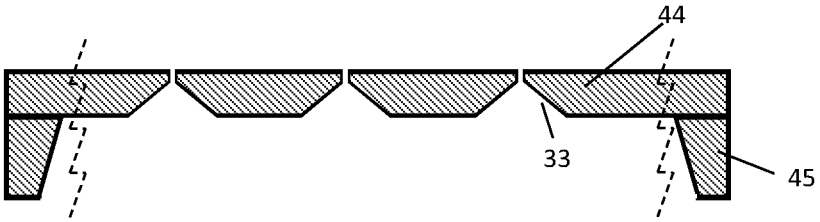

In the method step of FIG. 4*g*, an oxide wet-etching is performed in order to remove the unnecessary oxide such as, for example, the oxide left in the nozzles 31. Finally, if desired, a further oxidation step can be carried out in order to cover the whole structure with a layer of oxide.

Third Embodiment

FIGS. 5*a* to 5*g* schematically show the basic method steps of the third embodiment. In the third embodiment, silicon oxide is used as masking layer on both surfaces of the SOI wafer. In the method step of FIG. 5*a*, a silicon-on-insulator wafer 40 is provided. A silicon oxide layer 46 is formed on the external surface of the silicon-on-insulator wafer 40, preferably through thermal oxidation.

Figure 5A:
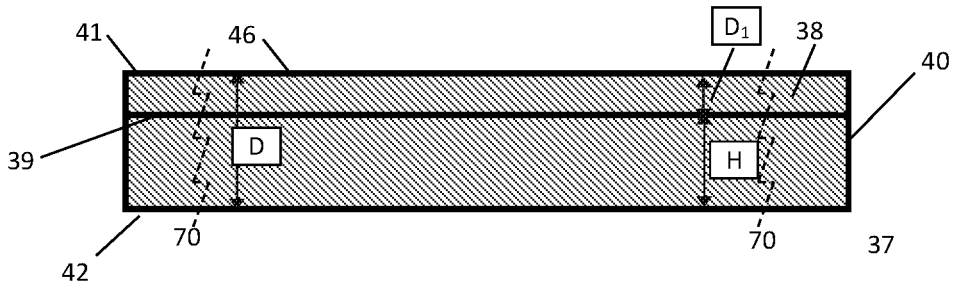
FIGS. 5*a*-5*g* schematically show exemplary steps carried out in a third embodiment of the method of manufacturing an ink-jet printhead.
Figure 5B:
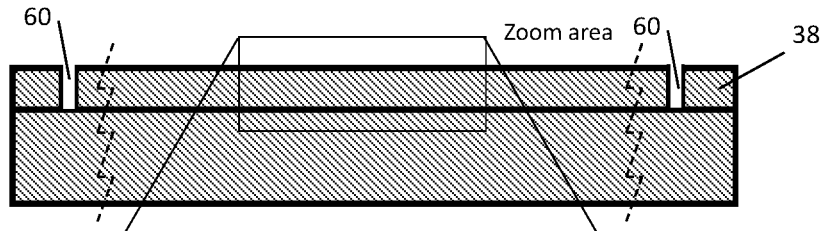

In the method step of FIG. 5*b*, through a first lithographic process and subsequent oxide etching, preferably a dry etching, and by a silicon etching method carried out on the first surface 41, a plurality of reference cavities 60 is formed.

Later on, an oxidation process is performed. The reference cavities 60 will not be part of respective nozzles, but will be used as a positional reference for the formation of the nozzles 31.

Figure 5C:
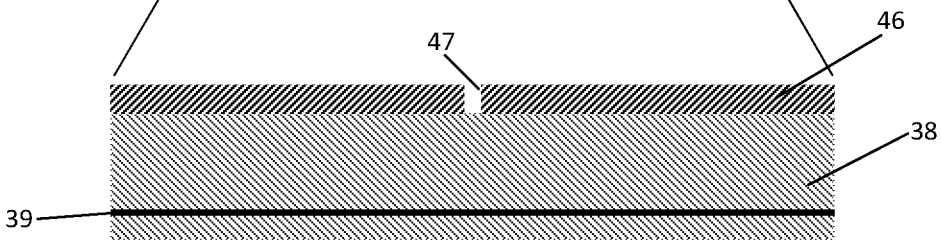

In the method step of FIG. 5*c*, which shows an enlarged view of a portion of FIG. 5*b*, through a second lithographic process, aligned with the first, and subsequent etching, preferably a dry etching process, a plurality of portions of silicon oxide 47 are removed from the silicon oxide layer on the first surface 41. Each area from which the oxide is removed will correspond to a respective nozzle.

Figure 5D:
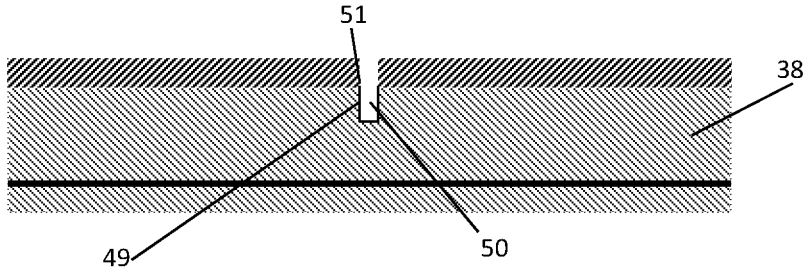

In the method step of FIG. 5*d*, a silicon dry-etching process, the "top portion etching step" referred to above, is performed so that the substantially cylindrical cavities 50 are formed at the first surface 41 that define the respective top portions 32, preferably having a substantially cylindrical shape, of the respective nozzle 31. In this embodiment, the longitudinal length of the cylindrical cavities 50 is substantially equal to the longitudinal length of the top portions 32, preferably having a substantially cylindrical shape, of the nozzles 31. Then, another oxidation process is carried out so as to cover also the surface of the substantially cylindrical cavities 50 with a layer of silicon oxide 49.

Figure 5E:
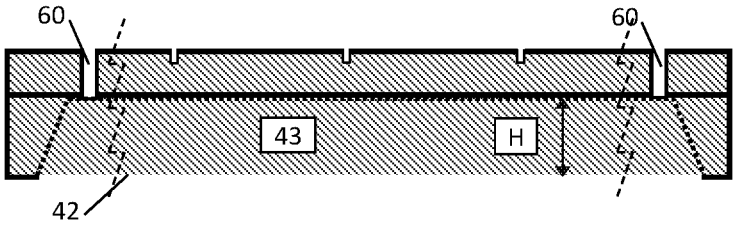

In the method step of FIG. 5*e*, an oxide etching is performed in order to remove, from the second surface 42, a central portion of oxide. The protection of the external ring could be obtained by means of a photolithographic masking process, a protective tape, or by using a wafer holder. Preferably, this oxide etching process is performed by means of wet-etching.

Figure 5F:
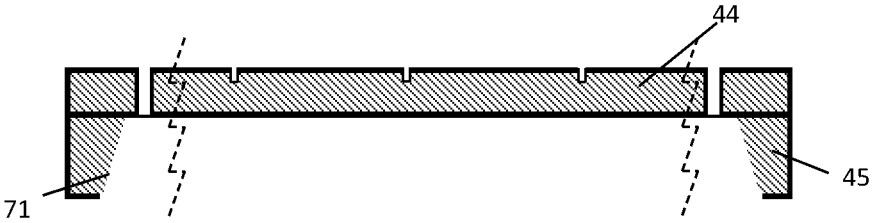

In the method step of FIG. 5*f*, the "thinning step" is performed, wherein the central portion 43 of the silicon-on-insulator wafer 40 is removed acting on the second surface 42 through a silicon wet-etching process, alternatively by grinding or dry etching. As a consequence, the silicon-on-insulator wafer 40 is now formed by the base portion 44 and the peripheral portion 45.

Figure 5G:
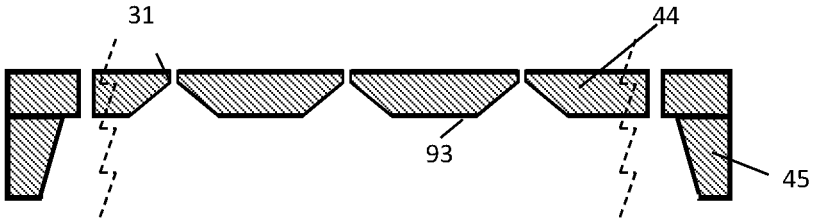

In the method step of FIG. 5*g*, another oxidation process is carried out so that the sloping surfaces of the peripheral portions 45 are covered with a layer of silicon oxide. It has to be noted that, after the oxide wet-etching of the previous step, the reference cavities 60 are now through holes that are visible both from the first surface 41 and from the second surface 42. Therefore, the reference cavities 60 can be used as positional references for the remaining steps to be carried out for the formation of the nozzles 31.

As described for the second embodiment, through a combination of lithographic process and oxide dry etching, portions of oxide, the oxide of the insulator layer 39, are removed where the nozzles 31 are supposed to be formed, i.e. at positions corresponding to the already formed substantially cylindrical cavities 50. Later on, a sequence of lithographic process, oxide dry etching and silicon anisotropic wet-etching is performed at the lower surface 44*a* of the base portion 44 opposite to the first surface 41.

Likewise, the bottom portions 33, preferably having a frusto-pyramidal shape, of the nozzles 31 are formed, each of them corresponding to a respective substantially cylindrical cavity 50.

Finally, an oxide wet-etching process removes the unnecessary oxide such as, for example, the oxide left in the nozzles 31 and, if required, another oxidation step can be carried out in order to cover the whole structure with a layer of oxide.

Fourth Embodiment

FIGS. 6*a* to 6*i* schematically show the basic method steps of the fourth embodiment. In the fourth embodiment, silicon oxide is used as masking layer on both surfaces of the SOI wafer. In the method step of FIG. 6*a*, a silicon-on-insulator wafer 40 is provided. A silicon oxide layer 46 is formed on the external surface of the silicon-on-insulator wafer 40, preferably through thermal oxidation.

In the method step of FIG. 6*b*, which shows a zoomed area with respect to FIG. 6*a*, through a first lithographic process and subsequent etching, preferably a dry etching, a plurality of portions of silicon oxide is removed from the first surface 41. Each area from which the oxide is removed will correspond to a respective nozzle.

In the method step of FIG. 6*c*, a silicon dry-etching process, the "top portion etching step" referred to above, is performed so that the substantially cylindrical cavities 50 are formed. In this embodiment, a longitudinal length of the cylindrical cavities 50 is substantially equal to the thickness of the base portion 44, in other words equal to the thickness of the device layer 38.

Then, an oxidation process is carried out so as to cover also the surface of the substantially cylindrical cavities 50 with a layer of silicon oxide 49.

In the method step of FIG. 6*d*, through a sequence of lithographic process and oxide dry etching, portions of oxide are removed around the substantially cylindrical cavities 50. The cylindrical cavities 50 are protected, during this silicon oxide dry etching process by a resist mask 48 applied during the lithographic process described here above.

In the method step of FIG. 6*e*, after the resist removal, an anisotropic silicon wet-etching process, the above mentioned "bottom portion etching step", forms the bottom portion 33, preferably having a frusto-pyramidal shape, on the first surface 41 where, in the previous step, the oxide has been removed.

In the method step of FIG. 6*f*, an oxide wet-etching process removes the unnecessary oxide such as, for example, the oxide left in the nozzles 31 and an oxidation step is carried out, to cover the whole structure with a new layer of oxide 91.

In the method step of FIG. 6*g*, an oxide etching is performed in order to remove, from the second surface 42, a central portion of oxide. The protection of the external ring could be obtained by means of a photolithographic masking process, a protective tape or by using a wafer holder. Preferably, this oxide etching process is performed by means of wet-etching.

In the method step of FIG. 6*h*, the "thinning step" is performed, wherein the central portion 43 of the silicon-on-insulator wafer 40 is removed, acting on the second surface 42 through a silicon wet-etching, alternatively by grinding or dry etching. As a consequence, the silicon-on-insulator wafer 40 is now formed by the base portion 44 and the peripheral portion 45.

In the method step of FIG. 6*i*, an oxide wet-etching process removes the not necessary oxide such as, for example, the oxide left in the nozzles 31 and, if required, another oxidation step can be carried out, to cover the whole structure with a new layer of oxide 92.

Fifth Embodiment

FIGS. 7*a* to 7*l* schematically show the basic method steps of a fifth embodiment. In the fifth embodiment, silicon oxide is used as masking layer on both surfaces of the SOI wafer.

In the method step of FIG. 7*a*, a silicon-on-insulator wafer 40 is provided. A silicon oxide layer 46, preferably having a thickness of 1,400 nm, is formed on the external surface of the silicon-on-insulator wafer 40, preferably through thermal oxidation.

In the method step of FIG. 7*b*, which shows an enlarged view of a portion of FIG. 7*a*, through a first lithographic process and subsequent etching, a plurality of portions 47 of silicon oxide are removed from the first surface 41. A single mask is employed to define the edges of the bottom portion and the top portion of the nozzle. Each area from which the oxide is removed will correspond to a respective nozzle. About half of the thickness of the silicon oxide layer, e.g. about 700 nm, is removed in this method step. Preferably the oxide etching in the method step of FIG. 7*b* is performed by means of dry-etching.

In the method step of FIG. 7*c*, through a second lithographic process, the silicon oxide layer is covered with a positive photoresist 48, which is then exposed and developed, leaving uncovered the portion of oxide corresponding to the top portion of the nozzle 90.

In the method step of FIG. 7*d*, etching of the silicon oxide portion exposed after step 7*c* is performed, completely removing the silicon oxide in the area corresponding to the nozzle and reducing the thickness, e.g. to about 700 nm, in the area around it. Preferably the oxide etching in step 7*d* is performed by means of dry-etching.

In the method step of FIG. 7*e*, a silicon dry-etching process, the "top portion etching step" referred to above, is performed so that the substantially cylindrical cavities 50 are formed. The oxide of the insulator layer 39 of the silicon-on-insulator wafer 40 in use acts as a stop etching layer during the cylindrical cavities dry etch step.

A longitudinal length of the substantially cylindrical cavities 50 is substantially equal to the thickness of the future base portion 44, in other words equal to the thickness of the device layer 38. After that, a silicon oxide layer 49, preferably having a thickness of 140 nm, is formed on the walls of the substantially cylindrical cavities 50, preferably through thermal oxidation.

In the method step of FIG. 7*f*, through a third lithographic process, the silicon oxide layer is covered with a negative photoresist 53, which is then exposed and developed, in order to cover the portion corresponding to the substantially cylindrical cavities 50 and leaving uncovered the remaining portion of the silicon oxide layer. The coating can be provided by deposition of a negative photoresist dry-film, or by spray coating of a liquid negative photoresist.

In the method step of FIG. 7*g*, the etching of the silicon oxide portion, exposed in the previous step, is performed, completely removing the silicon oxide in the area 54 corresponding to the edges of the nozzle bottom portion 33 and reducing the thickness e.g. to about 700 nm in the area around it. Preferably, the oxide etching described in FIG. 7*g*, is performed by means of dry-etching. After that, the photoresist is removed.

In the method step of FIG. 7*h*, an anisotropic silicon wet-etching process, the above mentioned "bottom portion etching step", forms the bottom portions 33, preferably having a substantially frusto-pyramidal shape, where the oxide has been removed in the previous method step.

Figure 7I:
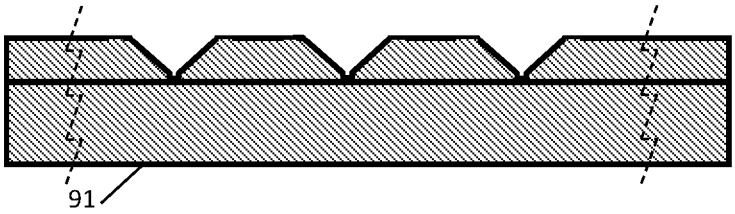

In the method step of FIG. 7*i*, zoomed out to the original wafer area, the etching of the silicon oxide is performed, completely removing the silicon oxide layers, back and front of the wafer, including the oxide left inside the nozzles 31. Preferably, this oxide etching method is performed by means of wet-etching. Later on, a new silicon oxide layer 91, preferably having a thickness of 140 nm, is formed on the whole surface, preferably through thermal oxidation.

Figure 7J:
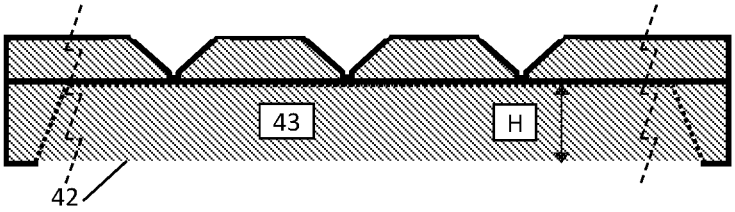

In the method step of FIG. 7*j*, an oxide etching is performed in order to remove, from the second surface 42, a central portion of oxide. The protection of the external ring could be obtained by means of a photolithographic masking process, a protective tape or by using a wafer holder. Preferably, this oxide etching process is performed by means of wet-etching.

Figure 7K:
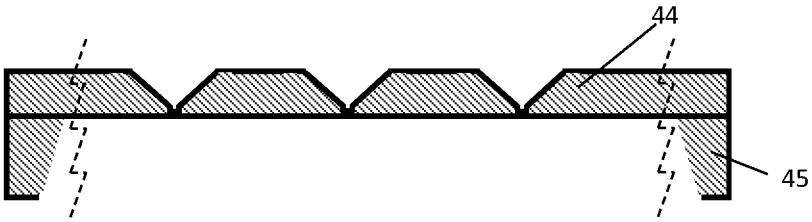

In the method step of FIG. 7*k*, the "thinning step" is performed, wherein the central portion 43 of the silicon-on-insulator wafer 40 is removed acting on the second surface 42 through a silicon wet-etching (alternatively by grinding or dry etching). As a consequence, the silicon-on-insulator wafer 40 is now formed by the base portion 44 and the peripheral portion 45.

Figure 7L:
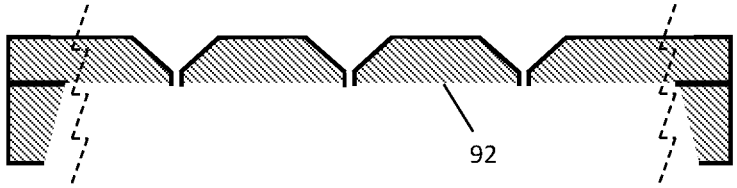

In the method step of FIG. 7*l*, an oxide wet-etching process completely removes all the oxide layers on the silicon-on-insulator wafer 40. In particular, it also removes the oxide of the insulator layer 39 and thus creates the openings in the nozzle top portions. Finally, if required, a final oxidation process can be performed to provide a new oxide layer 92.

Sixth Embodiment

FIGS. 8*a* to 8*g* schematically show the basic method steps of the sixth embodiment. In the sixth embodiment, silicon oxide is used as masking layer on both surfaces of the SOI wafer.

Figure 8A:
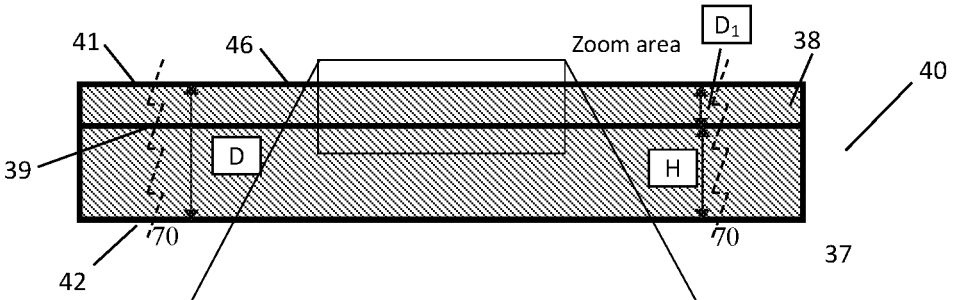
FIGS. 8*a*-8*g* schematically show exemplary steps carried out in a sixth embodiment of the method of manufacturing an ink-jet printhead.

In the method step of FIG. 8*a*, a silicon-on-insulator wafer 40 is provided. A silicon oxide layer 46, is formed on the external surface of the silicon-on-insulator wafer 40, preferably through thermal oxidation.

Figure 8B:
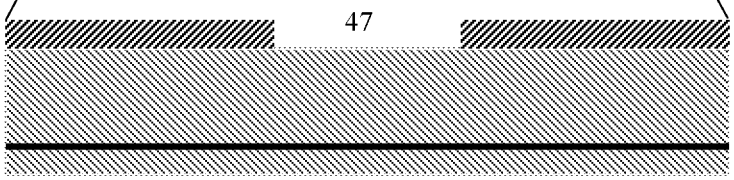

In the method step of FIG. 8*b*, which shows an enlarged view of a portion of FIG. 8*a*, through a lithographic process and subsequent etching, preferably a dry etching, a plurality of portions of silicon oxide 47 are removed from the first surface 41. Each area from which the oxide is removed will correspond to a respective nozzle.

Figure 8C:
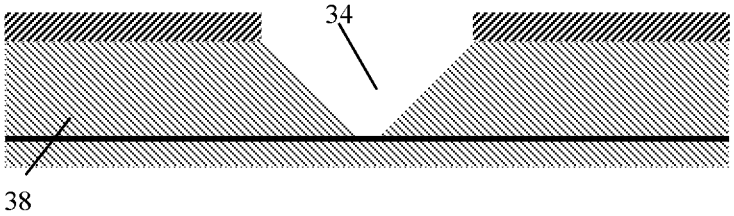

In the method step of FIG. 8*c*, an anisotropic silicon wet-etching process forms the single portion 34, preferably having a substantially frusto-pyramidal shape, where, in the previous step, the oxide has been removed. In this step the pyramid base width is chosen so that the final height of the pyramid or frusto-pyramid is equal to the silicon device thickness 38.

Figure 8D:
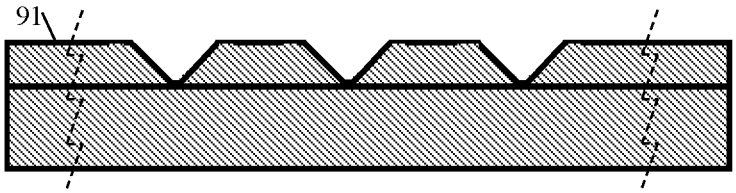

In the method step of FIG. 8*d* (zoomed out to the original wafer area), an oxide wet etching is performed in order to remove from both the first surface 41 and the second surface 42, the silicon oxide. After that, a new silicon oxide layer 91, preferably having a thickness of 140 nm, is formed on the whole surface, preferably through thermal oxidation.

Figure 8E:
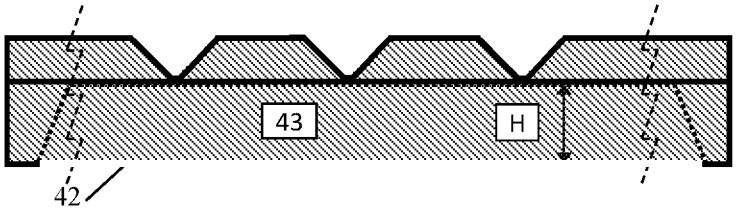

In the method step of FIG. 8*e*, an oxide etching is performed in order to remove, from the second surface 42, a central portion of oxide. The protection of the external ring could be obtained by means of a photolithographic masking process, a protective tape or by using a wafer holder. Preferably, this oxide etching process is performed by means of wet-etching.

Figure 8F:
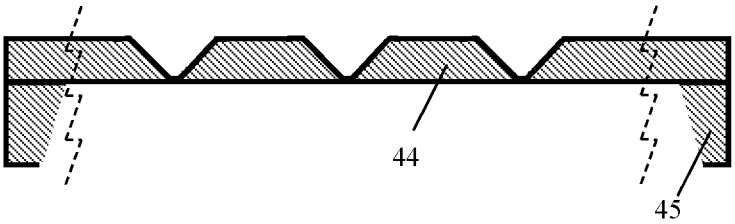

In the method step of FIG. 8*f*, the "thinning step" is performed, wherein the central portion 43 of the silicon-on-insulator wafer 40 is removed acting on the second surface 42 through a silicon wet-etching, alternatively by grinding or dry etching. As a consequence, the silicon-on-insulator wafer 40 is now formed by the base portion 44 and the peripheral portion 45.

Figure 8G:
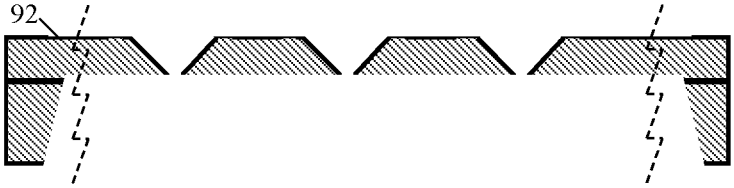

In the method step of FIG. 8*g*, an oxide wet-etching process removes the unnecessary oxide and finally, if desired, a further oxidation step can be carried out to provide a new oxide layer 92.

The invention claimed is:

1. A method of manufacturing an ink-jet printhead comprising:

providing a silicon substrate including active ejecting elements;

providing a hydraulic structure layer for defining hydraulic circuits configured to enable a guided flow of ink;

providing a silicon orifice plate having a plurality of nozzles for ejection of the ink;

assembling the silicon substrate with the hydraulic structure layer and the silicon orifice plate;

wherein providing the silicon orifice plate comprises:

providing a silicon wafer having a planar extension delimited by a first surface and a second surface on opposite sides of the silicon wafer;

performing a thinning step at the second surface so as to remove from the second surface a central portion having a preset height, the silicon wafer being formed, following the thinning step, by a base portion having a planar extension and a peripheral portion extending from the base portion, transversally with respect to the planar extension of the base portion;

forming in the base portion of the silicon wafer a plurality of through holes, each defining a respective nozzle for ejection of the ink, wherein the silicon wafer is a silicon-on-insulator wafer, wherein the silicon-on-insulator wafer comprises a silicon device layer adjacent to the first surface, a silicon handle layer adjacent to the second surface and an insulator layer in-between, and wherein the insulator layer of the silicon-on-insulator wafer comprises SiO and/or SiO2 and acts as a stop layer for the thinning step such that the preset height of the central portion removed by performing the thinning step is equal to a thickness of the silicon handle layer, wherein the step of forming a plurality of through holes in the silicon wafer comprises:

a top portion etching step wherein a plurality of cylindrical cavities are formed in the silicon wafer at the first surface, at least a part of each of the cylindrical cavities defining the top portion of a respective nozzle, each cylindrical cavity having a first longitudinal end at the first surface, and a second longitudinal end opposite to the first longitudinal end, wherein the insulator layer acts as a stop layer for the top portion etching step such that a longitudinal length of each of the cylindrical cavities is equal to a thickness of the silicon device layer; and a bottom portion etching step wherein a bottom portion is formed starting from the side of the second longitudinal end of each of the cylindrical cavities, thereby obtaining the nozzles;

wherein the thinning step is carried out after the top portion etching step and before the bottom portion etching step, and wherein, after the thinning step and before the bottom portion etching step, the second longitudinal ends of the cylindrical cavities are visible through the insulator layer and act as visual positional references for the formation of the bottom portions, wherein after the thinning step and before the bottom portion etching step, portions of the insulator layer are removed where the bottom portions are to be formed, at positions corresponding to the cylindrical cavities.

2. The method according to claim 1, wherein the thickness of the silicon device layer is between 10 and 100 μm.

3. The method according to claim 1, wherein the first and second surfaces are separated by a distance, a longitudinal length of the nozzles being defined by a difference between the distance and the preset height of the central portion.

4. The method according to claim 1, wherein the bottom portion of each of the nozzles has a frusto-pyramidal shape.

5. The method according to claim 1, wherein the top portion etching step is carried out through a dry-etching process.

6. The method according to claim 1, wherein the bottom portion etching step is carried out through a wet-etching process.

7. The method according to claim 1, wherein a masking step of the top portion etching step is performed with a first mask and a masking step of the bottom portion etching step is performed with a second mask.

8. The method according to claim 1, wherein the thinning step is carried out by an etching process.

9. The method according to claim 8, wherein the thinning step is carried out by wet-etching process.

10. The method according to claim 8, wherein the thinning step is carried out by reactive ion etching process or dry-etching process.

11. The method according to claim 1, wherein the thinning step is carried out by mechanical grinding.

12. The method according to claim 1, further comprising a dicing step, wherein the silicon wafer is cut and a plurality of orifice plates, including the orifice plate, is obtained.

13. The method according to claim 12, wherein the dicing step is carried out after the nozzles are formed.

14. The method according to claim 12, wherein the orifice plate is obtained through the dicing step as a portion of the base portion.

15. The method according to claim 1, wherein the insulator layer consists essentially of SiO and/or SiO2.

16. A method of manufacturing an ink-jet printhead comprising:

providing a silicon substrate including active ejecting elements;

providing a hydraulic structure layer for defining hydraulic circuits configured to enable a guided flow of ink;

providing a silicon orifice plate having a plurality of nozzles for ejection of the ink;

assembling the silicon substrate with the hydraulic structure layer and the silicon orifice plate;

wherein providing the silicon orifice plate comprises:

providing a silicon wafer having a planar extension delimited by a first surface and a second surface on opposite sides of the silicon wafer;

performing a thinning step at the second surface so as to remove from the second surface a central portion having a preset height, the silicon wafer being formed, following the thinning step, by a base portion having a planar extension and a peripheral portion extending from the base portion, transversally with respect to the planar extension of the base portion;

forming in the base portion of the silicon wafer a plurality of through holes, each defining a respective nozzle for ejection of the ink, wherein the silicon wafer is a silicon-on-insulator wafer, wherein the silicon-on-insulator wafer comprises a silicon device layer adjacent to the first surface, a silicon handle layer adjacent to the second surface and an insulator layer in-between, and wherein the insulator layer of the silicon-on-insulator wafer acts as a stop layer for the thinning step, wherein the method further comprises:

after the thinning step, selectively removing the insulator layer of the silicon-on-insulator wafer at position where the respective nozzle is supposed to be formed, wherein a surface of the silicon device layer acts as a stop layer for said selective removing of the insulator layer.

* * * * *